US009050705B2

(12) United States Patent
Shen et al.

(10) Patent No.: US 9,050,705 B2
(45) Date of Patent: Jun. 9, 2015

(54) CLAMPING MECHANISM FOR SURFACE BLASTING

(71) Applicants: Shi-Fu Shen, Shenzhen (CN); Shu-Sheng Wu, Shenzhen (CN)

(72) Inventors: Shi-Fu Shen, Shenzhen (CN); Shu-Sheng Wu, Shenzhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 219 days.

(21) Appl. No.: 13/632,283

(22) Filed: Oct. 1, 2012

(65) Prior Publication Data

US 2013/0147103 A1 Jun. 13, 2013

(30) Foreign Application Priority Data

Dec. 11, 2011 (CN) ..... 2011 2 0517173.2

(51) Int. Cl.
*B23Q 1/25* (2006.01)
*B24C 3/18* (2006.01)

(52) U.S. Cl.
CPC ..... *B24C 3/18* (2013.01)

(58) Field of Classification Search
CPC ..... B24C 3/18; B24C 3/00
USPC ..... 269/55, 43, 71, 147, 166, 201, 228, 45, 269/281.1; 451/80, 279
See application file for complete search history.

(56) References Cited

U.S. PATENT DOCUMENTS

| | | | | |
|---|---|---|---|---|
| 3,566,633 | A * | 3/1971 | Borck | 70/252 |
| 3,566,644 | A * | 3/1971 | Moore | 72/53 |
| 4,805,904 | A * | 2/1989 | Nye | 473/486 |
| 6,165,055 | A * | 12/2000 | Takahashi et al. | 451/278 |
| 8,172,706 | B2 * | 5/2012 | Peery et al. | 473/483 |
| 2002/0098776 | A1 * | 7/2002 | Dopper | 451/2 |
| 2008/0271378 | A1 * | 11/2008 | Le et al. | 49/89.1 |
| 2010/0257804 | A1 * | 10/2010 | Blachley | 52/473 |
| 2012/0090906 | A1 * | 4/2012 | Charnesky et al. | 180/68.1 |

* cited by examiner

*Primary Examiner* — Joseph J Hail
*Assistant Examiner* — Jordan Stolle
(74) *Attorney, Agent, or Firm* — Novak Druce Connolly Bove + Quigg LLP

(57) ABSTRACT

A clamping mechanism for surface blasting of workpieces includes a base seat, a following assembly and a linking assembly. The following assembly is mounted on the base seat. The linking assembly is mounted on the following assembly, in which the linking assembly includes a lower rod, an upper rod, at least two linking bars and a plurality of loading members; the lower rod, the upper rod and the at least two linking rods cooperatively forming a four-bar linkage mechanism. The plurality of loading members are fixed to the at least two linking bars, such that the plurality of loading members are capable of turning over workpieces for surface blasting without requiring any positional readjustment of the workpieces by hand.

5 Claims, 3 Drawing Sheets

CLAMPING MECHANISM FOR SURFACE BLASTING

BACKGROUND

1. Technical Field

The present disclosure relates to clamping mechanisms, and more particularly, to a clamping mechanism for use in surface-blasting.

2. Description of Related Art

An electronic device such as a mobile or media player may undergo a surface-blasting process to achieve a good surface appearance. A front surface and a back surface of a housing of the electronic device must both be processed such that the electronic device has an attractive appearance overall. The surface blasting process may include a plurality of steps as follows: 1) configuring the housing of the electronic device on a first clamping mechanism with the front surface of the housing facing a surface blasting device; 2) blasting the front surface of the electronic device; 3) configuring the housing of the electronic device on a second clamping mechanism with the back surface of the housing facing the surface blasting device; 4) blasting the back surface of the electronic device; 5) disassembling the electronic device from the second clamping mechanism. However, the described sand blasting process above requires of having two clamping mechanisms with multiple clamping and disassembling procedures, thus the conventional surface blasting process is labor-consuming, and the housing of the electronic device is vulnerable to scratching and being damaged during the clamping and disassembling steps.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
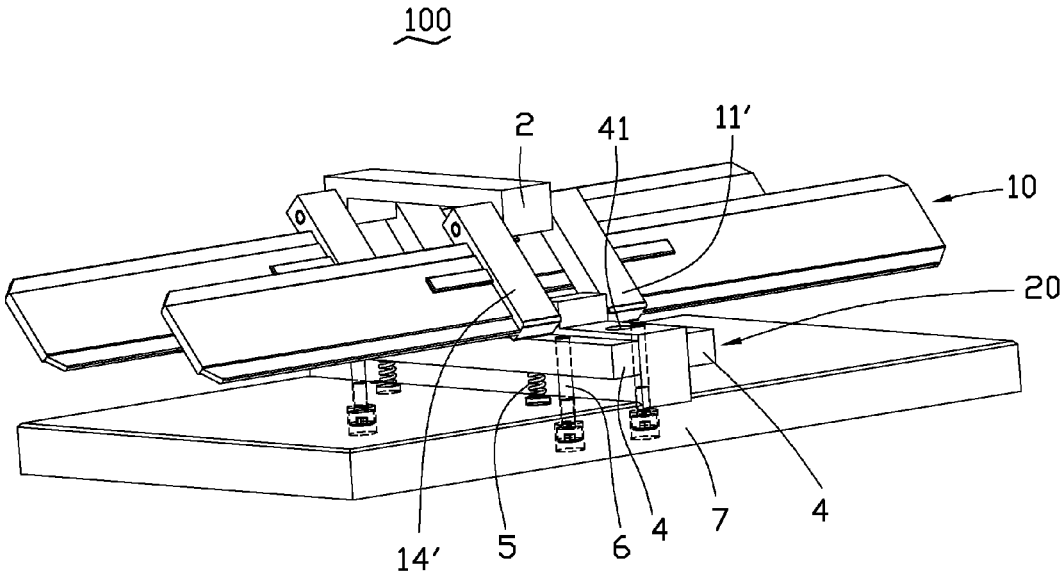
FIG. 1 is an assembled, isometric view of an embodiment of a clamping mechanism having a linking assembly.

FIG. 1 shows an embodiment of a clamping mechanism 100 for use in surface blasting and surface cleaning. The clamping mechanism 100 includes a base seat 7, a linking assembly 10 and a following assembly 20. The following assembly 20 is mounted on the base seat 7, the linking assembly 10 is mounted on the following assembly 20 and capable of rotating to change between two working states.

Figure 2:
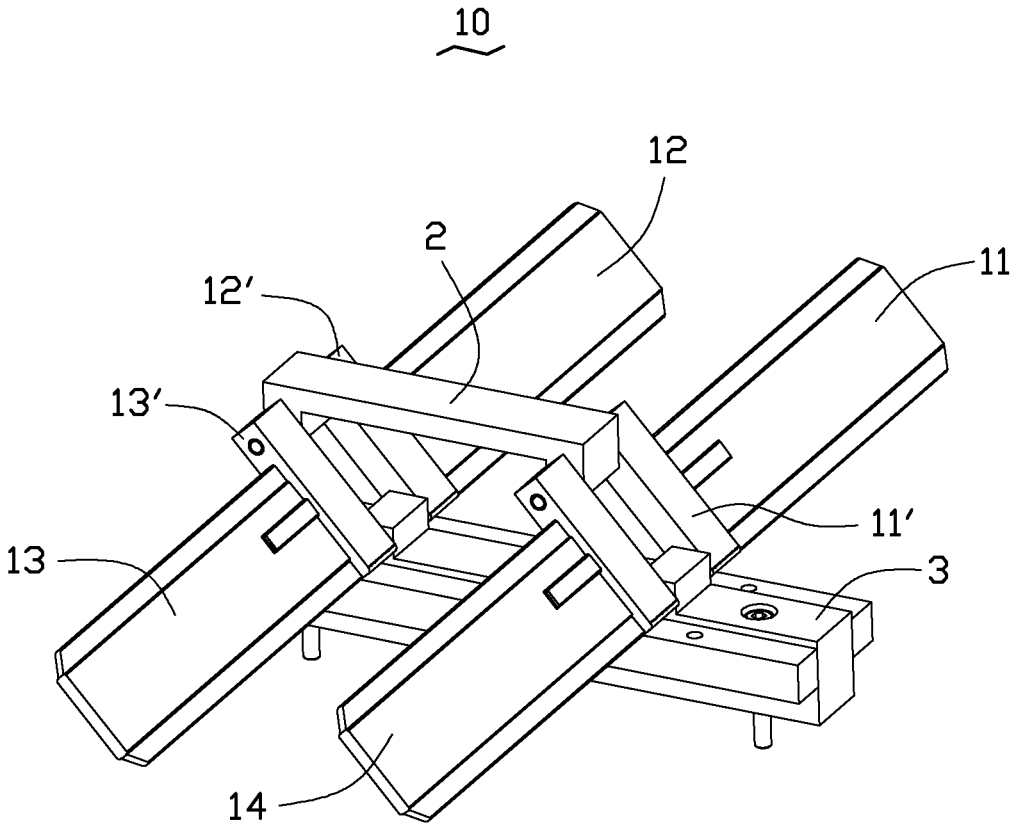
FIG. 2 is an assembled, isometric view of the linking assembly of the clamping mechanism of FIG. 1.

Referring to FIG. 2, the linking assembly 10 includes four loading members 11, 12, 13, and 14, four linking bars 11', 12', 13', and 14', and an upper rod 2 and a lower rod 3. The upper rod 2, the lower rod 3, the linking bars 11', 14', and the linking bars 12', 13' cooperatively form a four-bar linkage mechanism in the manner or shape of a rhomboid parallelogram. The four linking bars 11', 12', 13', and 14' are divided into a first group of the linking bars 11', 14' and a second group of the linking bars 12', 13'. The linking bars 11', 14' are distanced from and parallel to each other; the linking bars 12', 13' are distanced from and parallel to each other. An end of the upper rod 2 is rotatably connected to the first group of linking bars 11', 14' and rotatably connected to the second group of linking bars 12', 13' with the opposite end of the upper rod 2. The lower rod 3 is mounted on the base seat 7, and parallel to the upper rod 2. One end of the lower rod 3 is rotatably connected to the first group of linking bars 11', 14', and the other end of the lower rod 3 is rotatably connected to the second group of linking bars 12', 13'. Each of the four linking bars 11', 12', 13', and 14' has an end thereof located on a side of the lower rod 3. The ends of the four loading members 11, 12, 13, and 14 are respectively fixed to the four linking bars 11', 12', 13', and 14', and the four loading members 11, 12, 13, and 14 extend perpendicularly from the four linking bars 11', 12', 13', and 14', respectively.

The following assembly 20 includes two following members 4, four guiding members 6 and four elastic members 5. The two following members 4 are movably located at opposite sides of the lower rod 3 and resisted by the ends of the four linking bars 11', 12', 13', and 14'. Each following member 4 defines two guiding holes 41 corresponding to the guiding members 6, respectively. An end of the guiding member 6 is fixed to the base seat 7, while the opposite end of the guiding member 6 is slidably received in the guiding hole 41 of the following member 4. Each elastic member 5 connects the base seat 7 and the following member 4 together. Each of the elastic members 5 is configured between the base seat 7 and the corresponding following member 4.

In assembly, the upper rod 2, the lower rod 3, the first group of linking bars 11', 14', and the second group of linking bars 12', 13' cooperatively form a four-bar linkage mechanism. The lower rod 3 is mounted on the base seat 7. The four loading members 11, 12, 13, and 14 are perpendicularly fixed to the four linking bars 11', 12', 13', and 14' respectively. The linking assembly 10 is assembled to the following assembly 20, and the following assembly 20 is mounted on the base seat 7.

Figure 3A:
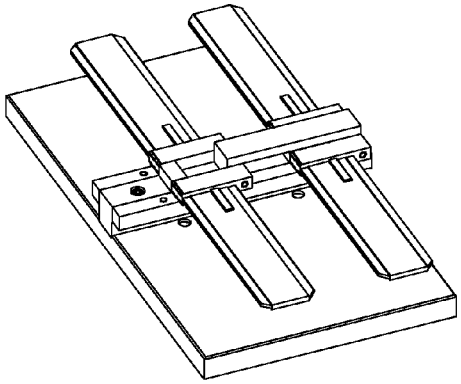
FIGS. 3A-3E show the rotating states of the clamping mechanism of FIG. 1.
Figure 3B:
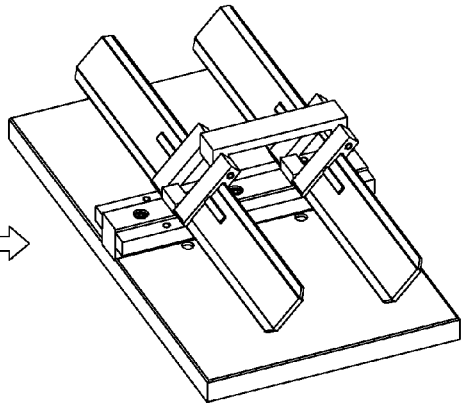
Figure 3C:
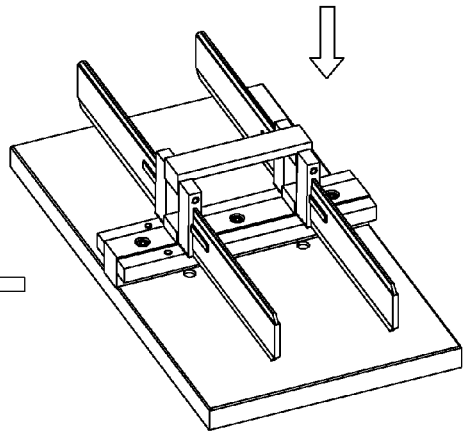
Figure 3D:
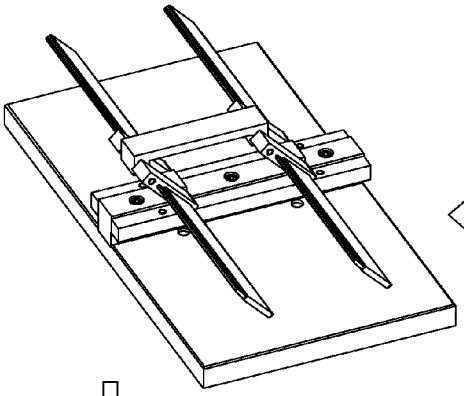
Figure 3E:
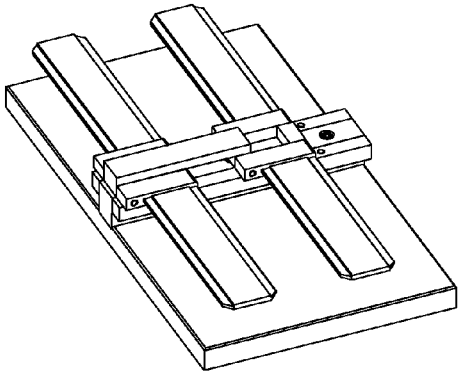

Referring to FIGS. 3A through 3E, when in use, workpieces (not shown) are mounted, held or attached on the loading members 11, 12, 13, and 14, and a surface blasting mechanism is employed first to blast a front surface of each workpiece. Then, a back surface of each workpiece is also to be blasted later on. Later, the four linking bars 11', 12', 13', and 14' are rotated to drive the loading members 11, 12, 13, and 14 to rotate, as shown in FIG. 3B. In the above rotation process, the ends of the linking bars 11', 12', 13', and 14' urge the pair of following members 4 to move toward the base seat 7, and thus the plurality of elastic members 5 is compressed. When the linking bars 11', 12', 13', and 14' are perpendicular to the base seat 7, the plurality of elastic members 5 are compressed to their respective uttermost position or smallest height, as shown in FIG. 3C. The four linking bars 11', 12', 13', and 14' then continue to drive the loading members 11, 12, 13, and 14 to rotate, while also making the plurality of elastic members 5 resisting the pair of following members 4 upward, as shown in FIG. 3D. When the four linking bars 11', 12', 13', and 14' rotate the loading members 11, 12, 13, and 14 to an another position where the back surface of each workpiece faces the surface blasting mechanism, the back surfaces of the workpieces are then correctly positioned for further blasting by the surface blasting mechanism, as shown in FIG. 3E. Both the front surface and the back surface of each workpiece can be blasted by the same surface blasting mechanism, when using the clamping mechanism, as a result, many of the loading and unloading steps are omitted or eliminated, and the clamping mechanism 100 is a significant labor-saver.

The number of the following members 4, of the guiding members 6, and of the elastic members 5 can be changed according to specific actual need. Each of the first group of linking bar 11', 14' and the second group of linking bars 12', 13' may include only one linking bar.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A clamping mechanism for surface blasting of one or more workpieces, comprising:

a base seat;

a following assembly;

a linking assembly mounted on the following assembly, wherein the linking assembly comprises a lower rod, an upper rod, at least two linking bars and a plurality of loading members, the lower rod, the upper rod and the at least two linking bars cooperatively form a four-bar linkage mechanism, the upper rod is rotatably connected to the one of the at least two linking bars with an end thereof, and rotatably connected to the other one of the at least two linking bars with an opposite end thereof, the lower rod is mounted on the base seat and parallel to the upper rod, the lower rod is rotatably connected to two of the at least two linking bars with opposite ends thereof, and the plurality of loading members are fixed to the at least two linking bars, such that the plurality of loading members are capable of clamping one or more workpieces thereon and further turning over the one or more workpieces for surface blasting;

wherein the following assembly comprises at least one following member, a plurality of guiding members and a plurality of elastic members, the at least one following member movably located on a side of the lower rod and resisted by the ends of the at least two linking bars, each following member defining at least one guiding holes thereon, an end of each guiding member fixed to the base seat, the opposite end of the guiding member slidably received in a corresponding guiding hole of the following member, and the plurality of elastic members being resisted between the base seat and the following member.

2. The clamping mechanism of claim 1, wherein each of the at least two linking bars has an end thereof located at a side of the lower rod, the at least two linking bars are rotatably connected to the lower rod by the ends thereof, the at least one following member is resisted by the ends of the at least two linking bars.

3. The clamping mechanism of claim 1, wherein the at least two linking bars comprises four linking bars divided into a first group and a second group, the upper rod is rotatably connected to the first group of the linking bars with an end thereof, and is rotatably connected to the second group of the linking bars with an opposite end thereof, the lower rod is mounted on the base seat and parallel to the upper rod, the lower rod is rotatably connected to the first group of linking bars and the second group of linking bars with opposite ends thereof.

4. A clamping mechanism for surface blasting for workpieces, comprising: a base seat; a following assembly; a linking assembly mounted on the following assembly, wherein the linking assembly comprises a lower rod, an upper rod, a first group of linking bars, a second group of linking bars and a plurality of loading members, the upper rod is rotatably connected to the first group of linking bars at an end thereof, and rotatably connected to the second group of linking bars with an opposite end thereof, the lower rod is mounted on the base seat and parallel to the upper rod, the lower rod is rotatably connected to the first group of linking bars and the second group of linking bars with opposite ends of the lower rod, and the plurality of loading members are fixed to the first and the second groups of linking bars, such that the plurality of loading members are capable of clamping one or more workpieces thereon and further turning over the one or more workpieces for surface blasting;

wherein the following assembly comprises at least one following member, a plurality of guiding members and a plurality of elastic members, the at least one following member movably located on a side of the lower rod and resisted by the ends of the at least two linking bars, each following member defining at least one guiding holes thereon, an end of each guiding member fixed to the base seat, the opposite end of the guiding member slidably received in a corresponding guiding hole of the following member, and the plurality of elastic members being resisted between the base seat and the following member.

5. The clamping mechanism of claim 4, wherein each of the at least two linking bars has an end located at a side of the lower rod, the at least two linking bars are rotatably connected to the lower rod by the ends of the linking bars, the at least one following member is resisted by the ends of the at least two linking bars.

* * * * *